US011092123B2

(12) United States Patent
Kanegae et al.

(10) Patent No.: US 11,092,123 B2
(45) Date of Patent: Aug. 17, 2021

(54) CONNECTOR

(71) Applicant: Sumitomo Riko Company Limited, Komaki (JP)

(72) Inventors: Ryousuke Kanegae, Komaki (JP); Yorihiro Takimoto, Komaki (JP); Ryuji Shibata, Komaki (JP); Yoshiki Kodaka, Komaki (JP); Makoto Ito, Komaki (JP)

(73) Assignee: SUMITOMO RIKO COMPANY LIMITED, Komaki (JP)

( * ) Notice: Subject to any disclaimer, the term of this patent is extended or adjusted under 35 U.S.C. 154(b) by 0 days.

(21) Appl. No.: 16/856,441

(22) Filed: Apr. 23, 2020

(65) Prior Publication Data

US 2020/0248661 A1 Aug. 6, 2020

Related U.S. Application Data

(63) Continuation of application No. PCT/JP2019/026228, filed on Jul. 2, 2019.

(30) Foreign Application Priority Data

Jul. 23, 2018 (JP) ..... JP2018-137331

(51) Int. Cl.
*F02M 37/00* (2006.01)
*F02M 37/04* (2006.01)
(Continued)

(52) U.S. Cl.
CPC ..... *F02M 37/0017* (2013.01); *F02M 37/00* (2013.01); *F02M 37/0023* (2013.01);
(Continued)

(58) Field of Classification Search
CPC ..... F02M 37/00; F02M 37/0017; F02M 37/0023; F02M 37/0029; F02M 37/0041;
(Continued)

(56) References Cited

U.S. PATENT DOCUMENTS 2,960,998 A * 11/1960 Sinker ..... F16K 15/063 137/542
3,053,500 A * 9/1962 Atkinson ..... F04B 53/1025 251/332
(Continued)

FOREIGN PATENT DOCUMENTS

DE 102015224941 A1 * 6/2017 ..... F16K 39/024
EP 0877163 A1 * 11/1998 ..... F02M 59/464
(Continued)

OTHER PUBLICATIONS

Aug. 20, 2019 International Search Report is issued in International Patent Application No. PCT/JP2019/026228.
(Continued)

*Primary Examiner* — John M Zaleskas
(74) *Attorney, Agent, or Firm* — Oliff PLC

(57) ABSTRACT

A connector includes: a connector body formed in a tubular shape; and a valve body stored inside the connector body, the valve body being configured to, when high-pressure fuel does not flow back, come into a first state in which a forward flow path is formed between the valve body and an inner circumferential surface of the connector body by a pressure of low-pressure fuel, and when high-pressure fuel flows back, come into a second state in which an orifice flow path having a smaller flow path sectional area than the forward flow path is formed between the valve body and the inner circumferential surface of the connector body.

14 Claims, 4 Drawing Sheets

(51) Int. Cl.
*F02M 55/04* (2006.01)
*F02M 55/00* (2006.01)
*F02M 59/44* (2006.01)
*F02M 37/06* (2006.01)

(52) U.S. Cl.
CPC ..... *F02M 37/04* (2013.01); *F02M 37/06* (2013.01); *F02M 55/00* (2013.01); *F02M 55/04* (2013.01); *F02M 59/44* (2013.01)

(58) Field of Classification Search
CPC ..... F02M 37/04; F02M 37/06; F02M 55/00; F02M 55/04; F02M 59/464
See application file for complete search history.

(56) References Cited

U.S. PATENT DOCUMENTS 3,559,678 A * 2/1971 Donner ..... F16K 15/044 137/535
3,565,100 A * 2/1971 Pfleger ..... F16K 15/026 137/269.5
4,766,930 A * 8/1988 Patti ..... F16K 15/026 137/540
5,092,361 A * 3/1992 Masuyama ..... F16K 15/026 137/543.21
5,794,657 A * 8/1998 Oberg ..... B60K 15/03 137/538
6,053,712 A * 4/2000 Konishi ..... F02M 63/0225 417/540
6,564,828 B1 * 5/2003 Ishida ..... F16F 1/06 137/515.5
6,953,052 B2 * 10/2005 Lehtonen ..... F02M 55/025 123/198 DB
7,124,738 B2 10/2006 Usui et al.
7,401,594 B2 7/2008 Usui et al.
7,441,545 B1 * 10/2008 Fisher ..... F02D 33/006 123/446
7,444,990 B1 * 11/2008 Fisher ..... F02D 33/006 123/459
2002/0036015 A1 * 3/2002 Miyajima ..... F16L 33/30 137/543.23
2004/0060599 A1 * 4/2004 Miyajima ..... F16K 17/082 137/515
2005/0019188 A1 1/2005 Usui et al.
2006/0185738 A1 * 8/2006 Nishiyama ..... F16L 37/40 137/543.23
2006/0185739 A1 * 8/2006 Niki ..... F16L 37/40 137/543.23
2006/0231078 A1 * 10/2006 Barylski ..... F02M 37/0082 123/511
2007/0079810 A1 4/2007 Usui et al.
2009/0068041 A1 * 3/2009 Beardmore ..... F04B 49/035 417/540
2010/0101538 A1 * 4/2010 Beardmore ..... F02M 59/466 123/495
2011/0114064 A1 * 5/2011 Akita ..... F02M 55/007 123/495
2011/0259302 A1 * 10/2011 Kim ..... F02M 59/26 123/506
2011/0278775 A1 * 11/2011 Germano ..... B60G 17/0528 267/64.23
2012/0073546 A1 * 3/2012 Blom ..... B08B 9/00 123/506
2012/0251367 A1 * 10/2012 Furuhashi ..... F04B 53/1082 417/505
2013/0213504 A1 * 8/2013 Yabuuchi ..... F02M 63/0056 137/565.15
2013/0312706 A1 * 11/2013 Salvador ..... F02M 63/0245 123/457
2013/0333672 A1 * 12/2013 Ryoo ..... F02M 37/0041 123/506
2014/0224209 A1 * 8/2014 Pursifull ..... F02D 41/3845 123/294
2014/0305410 A1 * 10/2014 Lucas ..... F02M 41/00 123/456
2014/0345706 A1 * 11/2014 Maibaum ..... F16K 15/026 137/223
2015/0027416 A1 * 1/2015 Brostrom ..... F02M 59/462 123/495
2015/0068491 A1 * 3/2015 Jensen ..... F02M 37/0023 123/294
2015/0337753 A1 * 11/2015 Stickler ..... F02M 63/005 123/506
2016/0258402 A1 * 9/2016 Abbas ..... F02M 59/025
2016/0363104 A1 * 12/2016 Sanborn ..... F02D 41/401
2016/0377017 A1 * 12/2016 Basmaji ..... F02D 41/3094 701/103
2017/0037824 A1 * 2/2017 Mack ..... F16K 15/025
2017/0050513 A1 * 2/2017 Hatanaka ..... B60K 15/04
2019/0003432 A1 * 1/2019 Kurt ..... F02M 37/0023
2019/0153983 A1 * 5/2019 Mason ..... F02M 37/0094
2020/0256294 A1 * 8/2020 Takimoto ..... F02M 55/025

FOREIGN PATENT DOCUMENTS

JP 2000-265926 A 9/2000
JP 2001207930 A * 8/2001 ..... F02M 63/0225
JP 2007-103203 A 4/2007
JP 2007-218264 A 8/2007
WO WO-2017121578 A1 * 7/2017 ..... F02M 63/0225

OTHER PUBLICATIONS

Aug. 20, 2019 Written Opinion issued in International Patent Application No. PCT/JP2019/026228.
Jun. 2, 2021 Office Action issued in Chinese Patent Application No. 20198006183.9.

* cited by examiner

CONNECTOR

CROSS REFERENCE TO RELATED APPLICATIONS

The present application is a Continuation Application of International Application No. PCT/JP2019/026228, filed on Jul. 2, 2019, which is incorporated herein by reference. The present invention is based on Japanese Patent Application No. 2018-137331, filed on Jul. 23, 2018, the entire contents of which are incorporated herein by reference.

BACKGROUND OF THE INVENTION

1. Field of the Invention

The present invention relates to a connector.

2. Description of the Related Art

As described in JP2007-218264A and JP2000-265926A, there are fuel supply systems in which low-pressure fuel supplied from a fuel tank by a low-pressure pump is pressurized by a high-pressure pump and the pressurized high-pressure fuel is supplied to an internal combustion engine. In the fuel supply systems, due to driving of the high-pressure pump, pulsation occurs in the low-pressure pipe through which the low-pressure fuel flows, and therefore reduction of the pulsation is required.

In JP2007-218264A, in order to reduce pulsation in the low-pressure pipe, a damper mechanism is provided. In JP2000-265926A, in order to reduce pulsation in the low-pressure pipe, a return path for returning a part of the fuel from the high-pressure pump to the low-pressure pipe side is provided and a solenoid valve and an orifice for opening the return path are provided.

SUMMARY OF INVENTION

However, providing the damper mechanism or the return path complicates the structure and leads to cost increase. An object of the present invention is to provide a connector that enables reduction of pulsation in the low-pressure pipe with use of a simple structure in a fuel supply system that supplies high-pressure fuel.

A connector according to the present invention is a connector to be connected to a low-pressure pipe through which low-pressure fuel supplied from a low-pressure pump flows, in a fuel supply system in which the low-pressure fuel is pressurized by a high-pressure pump and high-pressure fuel is supplied to an internal combustion engine. The connector includes: a connector body formed in a tubular shape; and a valve body stored inside the connector body, the valve body being configured to, when the high-pressure fuel does not flow back, come into a first state in which a forward flow path is formed between the valve body and an inner circumferential surface of the connector body by a pressure of the low-pressure fuel, and when the high-pressure fuel flows back, come into a second state in which an orifice flow path having a smaller flow path sectional area than the forward flow path is formed between the valve body and the inner circumferential surface of the connector body.

In the case where the high-pressure fuel flows back, the valve body comes into the second state, so that the orifice flow path is formed between the inner circumferential surface of the connector body and the valve body. That is, the orifice flow path is interposed between the high-pressure pump and the low-pressure pump. Owing to the action of the orifice flow path, pulsation in the low-pressure pipe on the low-pressure pump side with respect to the connector is reduced.

On the other hand, in the case of the steady state in which the high-pressure fuel does not flow back, the valve body comes into the first state, so that the forward flow path larger than the orifice flow path is formed between the inner circumferential surface of the connector body and the valve body. In the steady state, the valve body comes into the first state in which the forward flow path is formed by the pressure of the low-pressure fuel. Thus, the low-pressure fuel is assuredly supplied to the high-pressure pump side. That is, in the steady state, the valve body does not hamper flow of the low-pressure fuel.

In addition, the valve body is configured to be mounted in the connector. Thus, the valve body is easily provided. In particular, the inner circumferential surface of the connector body is used as a surface for forming the forward flow path and the orifice flow path. Since formation of the connector body is easy, formation of the forward flow path and the orifice flow path on the inner circumferential surface of the connector body is also easy. Thus, designing and manufacturing of the connector in which the valve body is mounted are facilitated.

Conceivably, the valve body is assumed to be mounted at the low-pressure pipe, instead of being mounted in the connector. However, mounting the valve body to the low-pressure pipe is not easy, as compared to the case of mounting the valve body to the connector body. Therefore, in the case of mounting the valve body to the low-pressure pipe, designing and manufacturing are not easy, and thus the cost increases. Therefore, as in the present invention, mounting the valve body inside the connector body facilitates designing and manufacturing and thus assuredly exerts the pulsation reducing effect.

DESCRIPTION OF THE EMBODIMENTS (1. Structure of Fuel Supply System 1)

Figure 1:
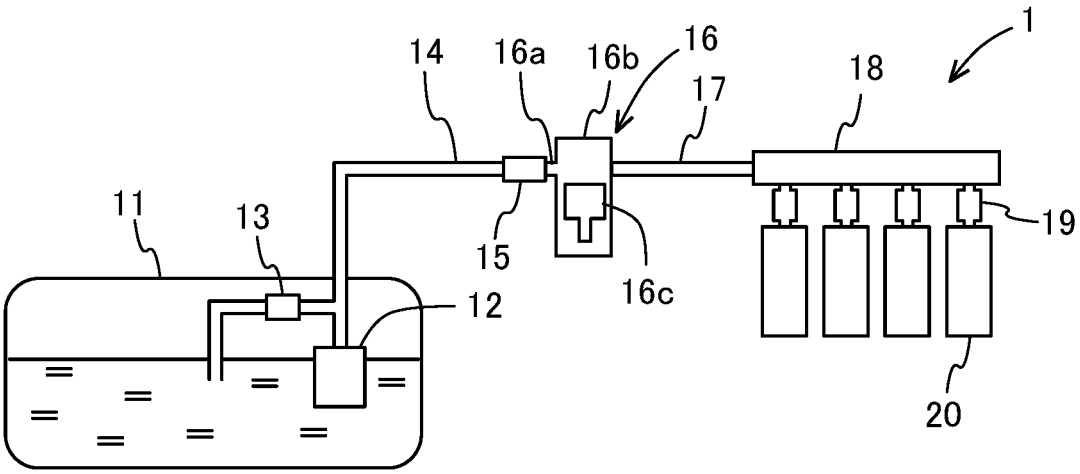
FIG. 1 shows a fuel supply system.

The structure of a fuel supply system 1 will be described with reference to FIG. 1. As shown in FIG. 1, the fuel supply system 1 is a system for performing supply from a fuel tank 11 to an internal combustion engine 20. Specifically, in the fuel supply system 1, low-pressure fuel supplied from a low-pressure pump 12 is pressurized by a high-pressure pump 16 and the high-pressure fuel is supplied to the internal combustion engine 20. The fuel supply system 1 includes the fuel tank 11, the low-pressure pump 12, a pressure regulator 13, a first low-pressure pipe 14, a connector 15, a high-pressure pump 16, a high-pressure pipe 17, a common rail 18, an injector 19, and the internal combustion engine 20.

The low-pressure pump 12 is provided inside the fuel tank 11, and a first end of the first low-pressure pipe 14 made of resin is connected to the discharge side of the low-pressure pump 12. That is, the low-pressure pump 12 pressure-feeds fuel stored in the fuel tank 11, to the first low-pressure pipe 14 side. The pressure regulator 13 is provided at the low-pressure pump 12 side on the first low-pressure pipe 14, inside the fuel tank 11. By the pressure regulator 13, the pressure of low-pressure fuel in the first low-pressure pipe 14 is regulated to a certain pressure.

A second end of the first low-pressure pipe 14 is connected to a first end (first tube portion 31 described later) of the connector 15. A second end (second tube portion 32 described later) of the connector 15 is connected to a second low-pressure pipe 16*a* provided integrally with the high-pressure pump 16. That is, the connector 15 is connected to low-pressure pipes (first low-pressure pipe 14 and second low-pressure pipe 16*a*) through which low-pressure fuel flows. More specifically, the connector 15 connects the first low-pressure pipe 14 and the second low-pressure pipe 16*a*, and forms a flow path for supplying low-pressure fuel, together with the first low-pressure pipe 14 and the second low-pressure pipe 16*a*.

Low-pressure fuel supplied from the low-pressure pump 12 and the pressure regulator 13 and having a certain pressure is introduced into a pump body 16*b* of the high-pressure pump 16 via the first low-pressure pipe 14, the connector 15, and the second low-pressure pipe 16*a*, and the pump body 16*b* discharges the pressurized high-pressure fuel. The pump body 16*b* of the high-pressure pump 16 pressurizes the low-pressure fuel by, for example, a reciprocating movement of a plunger 16*c*. For example, the plunger 16*c* is configured to perform a reciprocating movement by a cam moving in conjunction with a crankshaft. In this case, the plunger 16*c* continues performing a reciprocating movement while the crankshaft is operating.

The high-pressure fuel pressurized by the pump body 16*b* of the high-pressure pump 16 is supplied to the common rail 18 via the high-pressure pipe 17. The common rail 18 is provided with the injectors 19 the number of which corresponds to the number of cylinders of the internal combustion engine 20, and the injectors 19 are mounted to the internal combustion engine 20. Thus, the high-pressure fuel is injected to the internal combustion engine 20 via the common rail 18 and the injectors 19.

(2. Operation of Fuel Supply System 1)

Operation of the fuel supply system 1 will be described with reference to FIG. 1. In the case where high-pressure fuel needs to be supplied to the internal combustion engine 20, the low-pressure pump 12 and the high-pressure pump 16 operate. That is, by the low-pressure pump 12 operating, low-pressure fuel flows through the first low-pressure pipe 14, the connector 15, and the second low-pressure pipe 16*a* in the forward direction (direction from the low-pressure pump 12 to the high-pressure pump 16), and the low-pressure fuel is pressurized by the high-pressure pump 16. Then, the high-pressure fuel pressurized by the high-pressure pump 16 is supplied to the internal combustion engine 20 via the high-pressure pipe 17, the common rail 18, and the injectors 19.

On the other hand, during operation of the internal combustion engine 20, if high-pressure fuel need not be supplied to the internal combustion engine 20, high-pressure fuel is not supplied from the injectors 19 to the internal combustion engine 20. Since the plunger 16*c* of the high-pressure pump 16 operates in conjunction with the cam of the crankshaft, the plunger 16*c* is not stopped. At this time, if the low-pressure pump 12 continues operating, the low-pressure fuel continues being supplied to the high-pressure pump 16 via the first low-pressure pipe 14, the connector 15, and the second low-pressure pipe 16*a*. Therefore, the high-pressure fuel pressurized by the high-pressure pump 16 sometimes flows back to the second low-pressure pipe 16*a*, the connector 15, and the first low-pressure pipe 14.

The backflow of the high-pressure fuel causes pulsation in the first low-pressure pipe 14. Due to the pulsation in the first low-pressure pipe 14, the first low-pressure pipe 14 may vibrate, leading to occurrence of noise or the like. However, the connector 15 has a function of reducing the pulsation in the first low-pressure pipe 14. Thus, the pulsation in the first low-pressure pipe 14 is reduced and occurrence of noise or the like is suppressed.

(3. Structure of Connector 15 in First Embodiment)

(3-1. Entire Structure of Connector 15)

Figure 2:
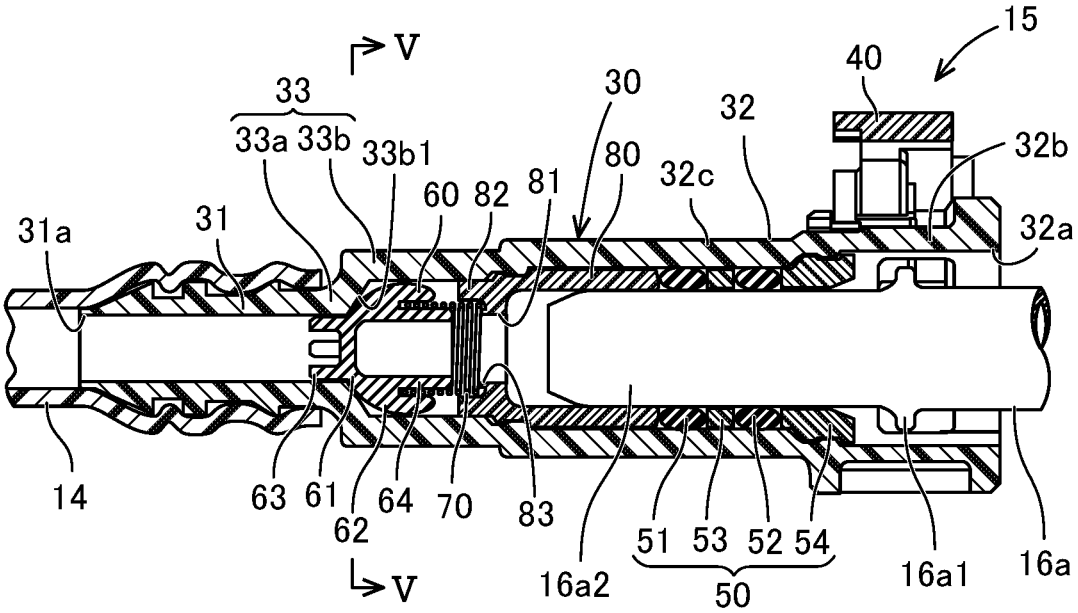
FIG. 2 is a sectional view of a connector according to the first embodiment, taken along the axial direction, and shows the case where a valve body composing the connector is in a second state, and in the drawing, the left side is a first low-pressure pipe (low-pressure pump) side, the right side is a second low-pressure pipe (high-pressure pump) side, and the retainer is at an initial position.

The structure of the connector 15 will be described with reference to FIG. 2 and FIG. 3. As shown in FIG. 2, the connector 15 connects the first low-pressure pipe 14 and the second low-pressure pipe 16*a* and allows fuel to flow between the first low-pressure pipe 14 and the second low-pressure pipe 16*a*. An end of the first low-pressure pipe 14 is externally fitted to the first end side of the connector 15, and an end of the second low-pressure pipe 16*a* is inserted to the second end side of the connector 15.

Here, the first low-pressure pipe 14 is, for example, made of resin, and is formed in a thin tubular shape. Therefore, the first low-pressure pipe 14 is formed to be deformable so as to increase the diameter thereof, as compared to the connector 15. The second low-pressure pipe 16*a* is, for example, made of metal or hard resin, and is formed in a tubular shape. The end of the second low-pressure pipe 16*a* has an annular flange 16*a*1 (also called bead) formed so as to protrude outward in the radial direction at a position distant in the axial direction from the endmost point, and an end portion 16*a*2 which is a small-diameter part on the head end side with respect to the annular flange 16*a*1.

The connector 15 includes a connector body 30, a retainer 40, a seal unit 50, a valve body 60, an energizing member 70, and a fixation bush 80. The connector body 30 is formed in a tubular shape having a first opening 31*a* and a second opening 32*a* at both ends. Thus, the connector body 30 allows fuel to flow between the first opening 31*a* connected to the first low-pressure pipe 14, and the second opening 32*a* connected to the second low-pressure pipe 16*a*. In other words, the connector body 30 is a member for fuel to flow between the first opening 31*a* and the second opening 32*a*.

In the present embodiment, the connector body 30 is formed in a straight tubular shape. However, the connector body 30 is not limited to a straight shape, but may be formed in a tubular shape having a bent portion (not shown), such as L-shaped tubular shape. The connector body 30 is integrally molded with hard resin, and is formed from one member. For example, the connector body 30 is integrally molded by injection molding. The connector body 30 is made of, for example, glass fiber reinforced polyamide.

The connector body 30 has the first tube portion 31, the second tube portion 32, and a third tube portion 33 when divided in the flow path direction. In the flow path direction, the first tube portion 31, the third tube portion 33, and the second tube portion 32 are connected in this order.

The first tube portion 31 is a part to be connected to the first low-pressure pipe 14. The first tube portion 31 is a part having the first opening 31*a* and is formed in a straight tubular shape. The first opening 31*a* is an opening on a side where the end of the first low-pressure pipe 14 is externally fitted. The first tube portion 31 corresponds to an area that overlaps the first low-pressure pipe 14 in the flow path direction in a state in which the end of the first low-pressure pipe 14 is fitted to the outer circumference of the first tube portion 31 on the first opening 31*a* side. That is, the outer circumferential surface of the first tube portion 31 is opposed to the inner circumferential surface of the first low-pressure pipe 14, in the radial direction, over the entire length.

The inner circumferential surface of the first tube portion is formed in a cylindrical shape. Further, the inner circumferential surface of the first tube portion 31 forms a surface with which fuel comes into direct contact. On the other hand, the outer circumferential surface of the first tube portion 31 is formed in a recessed and projecting shape in a cross section taken along the flow path direction so that the first low-pressure pipe 14 externally fitted thereto does not come off. Here, the first tube portion 31 is formed of a material that is less deformable than the first low-pressure pipe 14. Therefore, in a state in which the first low-pressure pipe 14 is externally fitted to the first tube portion 31, the first tube portion 31 is hardly deformed while the diameter of the first low-pressure pipe 14 is expanded. That is, the first low-pressure pipe 14 is deformed along the recesses and projections on the outer circumferential surface of the first tube portion 31.

The second tube portion 32 is a part connected to the second low-pressure pipe 16*a*, and is a part at which the retainer 40 and the seal unit 50 are placed. The second tube portion 32 includes a retainer placement portion 32*b* on the second opening 32*a* side.

The retainer placement portion 32*b* has a hole penetrating in the radial direction and is a part at which the retainer 40 is placed. The retainer placement portion 32*b* is configured to be engaged with the retainer 40 in the radial direction. The second tube portion 32 includes a seal portion 32*c* on a side of the retainer placement portion 32*b* opposite to the second opening 32*a*. The inner circumferential surface of the seal portion 32*c* is formed in a cylindrical shape. The seal unit 50 is provided on the inner circumferential side of the seal portion 32*c*. Here, the diameter of the inner circumferential surface of the second tube portion 32 is greater than the diameter of the inner circumferential surface of the first tube portion 31. The diameter of the inner circumferential surface of the first tube portion 31 is equal to the inner diameter of the second low-pressure pipe 16*a*.

The third tube portion 33 is a part where the valve body 60, the energizing member 70, and the fixation bush 80 are provided. The third tube portion 33 connects a side of the first tube portion 31 opposite to the first opening 31*a*, and a side of the second tube portion 32 opposite to the second opening 32*a*, in the flow path direction. The third tube portion 33 corresponds to an area in which neither the first low-pressure pipe 14 nor the second low-pressure pipe 16*a* is present.

The third tube portion 33 includes a small-diameter tube portion 33*a* and a large-diameter tube portion 33*b*. The small-diameter tube portion 33*a* is connected coaxially to the first tube portion 31. Thus, the small-diameter tube portion 33*a* is located on the first opening 31*a* side in the third tube portion 33. The diameter of the inner circumferential surface of the small-diameter tube portion 33*a* is equal to the diameter of the inner circumferential surface of the first tube portion 31. Thus, the small-diameter tube portion 33*a* forms a small-diameter flow path in the third tube portion 33.

The large-diameter tube portion 33*b* is connected coaxially to the second tube portion 32. Thus, the large-diameter tube portion 33*b* is located on the second opening 32*a* side in the third tube portion 33. The diameter of the inner circumferential surface of the large-diameter tube portion 33*b* is almost equal to the diameter of the inner circumferential surface of a part into which the endmost part (part having an opening in the end portion 16*a*2) of the second low-pressure pipe 16*a* is inserted, in the second tube portion 32. The inner circumferential surface of the boundary part between the small-diameter tube portion 33*a* and the large-diameter tube portion 33*b* has a tapered first contact portion 33*b*1. The diameter of the first contact portion 33*b*1 increases from the inner circumferential surface of the small-diameter tube portion 33*a* toward the inner circumferential surface of the large-diameter tube portion 33*b*. Further, the inner circumferential surface of the large-diameter tube portion 33*b* has an annular groove and an annular projection, near the center in the axial direction, or on the second tube portion side. Thus, the large-diameter tube portion 33*b* forms a large-diameter flow path in the third tube portion 33. In the present embodiment, the large-diameter tube portion 33*b* and the small-diameter tube portion 33*a* are connected coaxially with each other.

The retainer 40 is made of, for example, glass fiber reinforced polyamide. The retainer 40 is retained at the retainer placement portion 32*b* of the connector body 30. The retainer 40 is a member for coupling the connector body 30 and the second low-pressure pipe 16*a* with each other. It is noted that the retainer 40 is not limited to the structure described below and various known structures may be employed.

The retainer 40 is movable in the radial direction of the retainer placement portion 32*b* by operator's push-in operation and pull-out operation. When the second low-pressure pipe 16*a* is inserted to a regular position in the second tube portion 32, the retainer 40 becomes movable from an initial position shown in FIG. 2 (position shown in FIG. 2) to a confirmation position (position moved downward in FIG. 2; position not shown). Therefore, when the retainer 40 is allowed to be pushed-in, the operator can confirm that the second low-pressure pipe 16*a* has been inserted to the regular position in the second tube portion 32.

In a state in which the retainer 40 is pushed-in to the confirmation position, the retainer 40 is engaged with the annular flange 16*a*1 of the second low-pressure pipe 16*a* in the pipe pull-out direction so that the retainer 40 prevents the second low-pressure pipe 16*a* from being pulled out. That is, by performing push-in operation of the retainer 40, the operator can confirm that the second low-pressure pipe 16*a* has been inserted to the regular position in the second tube portion 32 and the second low-pressure pipe 16*a* is prevented by the retainer 40 from being pulled out.

The seal unit 50 restricts flow of fuel between the inner circumferential surface of the second tube portion 32 of the connector body 30 and the outer circumferential surface of the second low-pressure pipe 16*a*. The seal unit 50 includes annular seal members 51, 52 made of fluororubber or the like, a collar 53 made of resin and sandwiched in the axial direction between the annular seal members 51, 52, and a bush 54 made of resin and positioning the annular seal members 51, 52 and the collar 53 in the seal portion 32*c* of the second tube portion 32. On the inner circumferential side of the seal unit 50, the end portion 16*a*2 of the second low-pressure pipe 16*a* is inserted, and the annular flange 16*a*1 of the second low-pressure pipe 16*a* is located on the second opening 32*a* side with respect to the seal unit 50.

The valve body 60 functions to allow the low-pressure fuel to flow in the forward direction in the case where the high-pressure fuel does not flow back, and reduce pulsation in the case where the high-pressure fuel flows back. The valve body 60 is stored inside the third tube portion 33 of the connector body 30, and is movable in the axial direction of the large-diameter tube portion 33*b* of the third tube portion 33. The valve body 60 is integrally formed by metal or hard resin.

The valve body 60 includes a valve main body portion 61, a large-diameter restriction portion 62, a small-diameter restriction portion 63, and a mounting portion 64. The valve main body portion 61 is formed in a plate shape or a bottomed tubular shape as shown in FIG. 2 to FIG. 4. In the present embodiment, the valve main body portion 61 is formed in a plate shape. In the case where the valve main body portion 61 has a plate shape, the plate shape forms a closing surface having no through holes. On the other hand, in the case where the valve main body portion 61 has a bottomed tubular shape, the bottom portion thereof forms a closing surface having no through holes.

Figure 3:
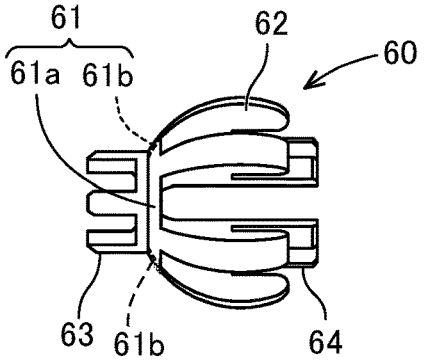
FIG. 3 is an enlarged front view of the valve body composing the connector according to the first embodiment.
Figure 4:
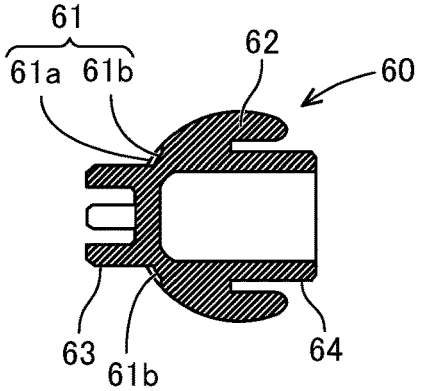
FIG. 4 is a sectional view of the valve body shown in FIG. 3, taken along the axial direction.

The outer circumferential surface of the valve main body portion 61 has a second contact portion 61*a* and a second orifice groove 61*b* as shown in FIG. 3 and FIG. 4. The second contact portion 61*a* is formed in a partially spherical shape. The second contact portion 61*a* is contactable with the first contact portion 33*b*1 of the third tube portion 33 of the connector body 30. That is, the second contact portion 61*a* moves between a position in contact with the first contact portion 33*b*1 and a position separate therefrom.

Here, the first contact portion 33*b*1 of the third tube portion 33 has a tapered shape, whereas the second contact portion 61*a* of the valve main body portion 61 has a partially spherical shape. Therefore, the first contact portion 33*b*1 and the second contact portion 61*a* come into linear contact with each other. Further, even if the attitude of the valve main body portion 61 is slightly changed, the first contact portion 33*b*1 and the second contact portion 61*a* assuredly come into contact with each other, because the second contact portion 61*a* has a partially spherical shape.

The second orifice groove 61*b* is formed so as to extend in the axial direction, or in a helical shape. A plurality of second orifice grooves 61*b* are formed at regular intervals in the circumferential direction. Thus, the second orifice grooves 61*b* are provided so as to be adjacent to the second contact portion 61*a* in the circumferential direction. In FIG. 3, an example in which the number of the second orifice grooves 61*b* is two is shown, but the number of the second orifice grooves 61*b* may be one or may be three or more. Providing the plurality of second orifice grooves 61*b* at regular intervals enables fuel to flow in a balanced manner.

The large-diameter restriction portion 62 is formed integrally with the valve main body portion 61, and extends toward the second tube portion 32 side from an outer circumferential edge of a surface of the valve main body portion 61 on the second tube portion 32 side. As shown in FIG. 3, the large-diameter restriction portions 62 are formed as a plurality of claw-shaped portions, and gaps through which fuel flows are formed between the adjacent large-diameter restriction portions 62 in the circumferential direction. In the present embodiment, six large-diameter restriction portions 62 are provided as an example. However, any number of large-diameter restriction portions 62 may be provided.

The radially outer surface of each large-diameter restriction portion 62 is formed in a partially spherical shape concentric with the second contact portion 61*a* at the outer circumferential surface of the valve main body portion 61. The radially outer surface of the large-diameter restriction portion 62 is contactable with the inner circumferential surface (part excluding the first contact portion 33*b*1) of the large-diameter tube portion 33*b* of the third tube portion 33. Thus, the large-diameter restriction portion 62 has a function of restricting the attitude of the valve body 60 relative to the third tube portion 33. However, since the valve body 60 is provided so as to be movable inside the third tube portion 33, the large-diameter restriction portion 62 is located with a slight gap from the large-diameter tube portion 33*b* of the third tube portion 33. Therefore, the attitude of the valve body 60 is slightly changeable.

The small-diameter restriction portion 63 is formed integrally with the valve main body portion 61, and extends in parallel to the axial direction toward the first tube portion 31 from a surface of the valve main body portion 61 on the first tube portion 31 side. As shown in FIG. 3, the small-diameter restriction portions 63 are formed as a plurality of claw-shaped portions, and gaps through which fuel flows are formed between the adjacent small-diameter restriction portions 63 in the circumferential direction. In the present embodiment, four small-diameter restriction portions 63 are provided as an example. However, any number of small-diameter restriction portions 63 may be provided.

The radially outer surface of each small-diameter restriction portion 63 comes into contact with the inner circumferential surface of the small-diameter tube portion 33*a* of the third tube portion 33. That is, the small-diameter restriction portion 63 is contactable with the inner circumferential surface of the small-diameter tube portion 33*a* of the third tube portion 33. Thus, the small-diameter restriction portion 63 restricts the attitude of the valve body 60 relative to the third tube portion 33. However, since the valve body 60 is provided so as to be movable inside the third tube portion 33, the small-diameter restriction portion 63 is located with a slight gap from the small-diameter tube portion 33*a* of the third tube portion 33. Therefore, the attitude of the valve body 60 is slightly changeable.

The mounting portion 64 is formed to extend in parallel to the axial direction from the radially inner surface of the large-diameter restriction portion 62 toward the second tube portion 32 side. As shown in FIG. 3, the mounting portion 64 is formed as a plurality of claw-shaped portions, and gaps through which fuel flows are formed between the adjacent mounting portions 64 in the circumferential direction. In the present embodiment, as an example, the number of the mounting portions 64 is six, which is equal to the number of the large-diameter restriction portions 62. However, any number of the mounting portions 64 may be provided. Further, the radially outer surface of each mounting portion 64 is opposed to the radially inner surface of the large-diameter restriction portion 62 with a radial-direction gap therebetween.

The energizing member 70 is mounted on the radially outer surface side of the mounting portions 64, and energizes the valve body 60 toward the first contact portion 33*b*1. The energizing member 70 is a coil spring, as an example. However, another type of spring may be applied. Since the attitude of the energizing member 70 is maintained, an energizing force in a direction toward the first contact portion 33*b*1 is assuredly applied to the valve body 60. In addition, the energizing force of the energizing member 70 is set to be not greater than the pressure of the low-pressure fuel. Therefore, the energizing member 70 is compressed when the pressure of the low-pressure fuel is applied thereto.

The fixation bush 80 is made of metal or hard resin, and is formed in a tubular shape having a through hole, as shown in FIG. 2. The through hole of the fixation bush 80 serves as a flow path for fuel. The outer circumferential surface of the fixation bush 80 has an annular projection and an annular groove corresponding to the annular groove and the annular projection on the inner circumferential surface of the large-diameter tube portion 33*b*. By engagement therebetween, the fixation bush 80 is positioned in the axial direction relative to the third tube portion 33.

The fixation bush 80 includes an annular inner protrusion 81 protruding inward in the radial direction, an end tube portion extending toward the valve body 60 side from the outer circumferential side of the inner protrusion 81, and an annular axial protrusion 83 protruding toward the valve body 60 side from the inner circumferential side of the inner protrusion 81 and partially opposed to the end tube portion 82. The energizing member 70 is placed between the end tube portion 82 and the axial protrusion 83 in the radial direction, and is supported by an end surface of the inner protrusion 81. Thus, the fixation bush 80 restricts the movement range of the valve body 60 and the energizing member 70 so that the second contact portion 61*a* of the valve body 60 assuredly comes into contact with the first contact portion 33*b*1.

(3-2. Action of Valve Body 60)

Figure 5:
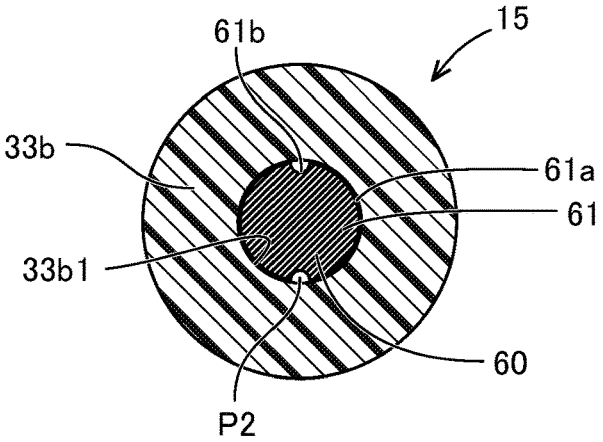
FIG. 5 is an enlarged sectional view taken along line V-V in FIG. 2.
Figure 6:
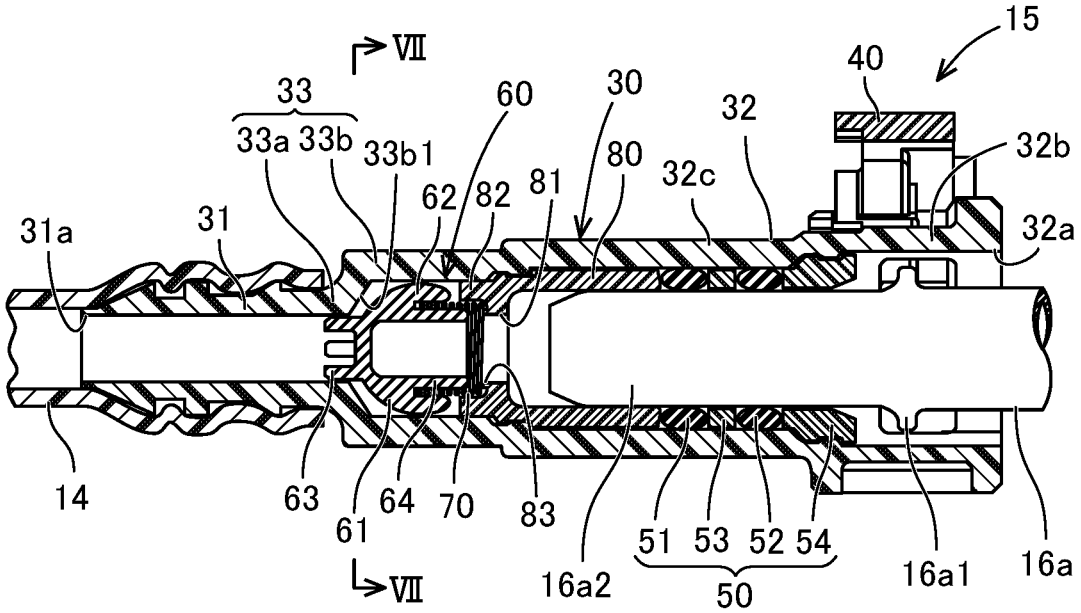
FIG. 6 is a sectional view of the connector according to the first embodiment, taken along the axial direction, and shows the case where the valve body is in a first state.
Figure 7:
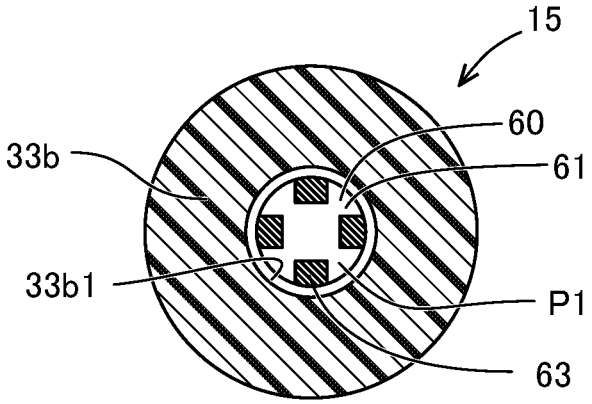
FIG. 7 is an enlarged sectional view taken along line VII-VII in FIG. 6.

The action of the valve body 60 will be described with reference to FIG. 2 and FIG. 5 to FIG. 7. Here, FIG. 6 and FIG. 7 show the case where the valve body 60 is in a first state, and FIG. 2 and FIG. 5 show the case where the valve body 60 is in a second state.

The first state is a state in which the valve body 60 forms a forward flow path P1 between the valve body 60 and the inner circumferential surface of the third tube portion 33 of the connector body 30 by the pressure of the low-pressure fuel in the case where the high-pressure fuel does not flow back. The second state is a state in which the valve body 60 forms an orifice flow path P2 having a smaller flow path sectional area than the forward flow path P1 between the valve body 60 and the inner circumferential surface of the third tube portion 33 of the connector body 30 in the case where the high-pressure fuel flows back.

First, the case where the valve body 60 is in the first state will be described with reference to FIG. 6 and FIG. 7. In the case where the high-pressure fuel does not flow back, the low-pressure fuel regulated to a certain pressure by the low-pressure pump 12 and the pressure regulator 13 is supplied to the pump body 16*b* of the high-pressure pump 16 via the first low-pressure pipe 14, the connector 15, and the second low-pressure pipe 16*a*. At this time, in the connector 15, the flowing direction of the low-pressure fuel is a direction from the first tube portion 31 toward the second tube portion 32 of the connector body 30 (from left to right in FIG. 6). Therefore, a force that the valve body 60 receives from the low-pressure fuel acts in a direction against the energizing force of the energizing member 70.

Here, the energizing force of the energizing member 70 is set to be not greater than the regulated pressure of the low-pressure fuel. Therefore, when the pressure of the low-pressure fuel acts on the valve body 60, the energizing member 70 is compressed. Accordingly, as shown in FIG. 6 and FIG. 7, the valve main body portion 61 of the valve body 60 is located at a first-state position distant from the first contact portion 33*b*1 of the third tube portion 33 of the connector body 30. Thus, the forward flow path P1 is formed between the first contact portion 33*b*1 and the second contact portion 61*a* of the valve main body portion 61 of the valve body 60. The forward flow path P1 is formed around the entire circumference in the circumferential direction of the valve main body portion 61. Further, in the forward flow path P1, the pressure of the low-pressure fuel is hardly reduced. Therefore, the low-pressure fuel flows into the pump body 16*b* of the high-pressure pump 16, in a state of being kept at a desired pressure.

Next, the case where the valve body 60 is in the second state will be described with reference to FIG. 2 and FIG. 5. In the case where the high-pressure fuel flows back, the high-pressure fuel exists in the second low-pressure pipe 16*a*. Meanwhile, the low-pressure fuel exists in the first low-pressure pipe 14. The fuel acting on the valve body 60 has a pressure difference. Accordingly, the high-pressure fuel attempts to flow from the second low-pressure pipe 16*a* to the first low-pressure pipe 14 side. Thus, the valve body 60 is pressed to the first contact portion 33*b*1 side by the pressure of the high-pressure fuel, so as to come to a second-state position.

Since the second contact portion 61*a* of the valve main body portion 61 of the valve body 60 and the first contact portion 33*b*1 are in contact with each other, flow of the high-pressure fuel in the circumferential-direction contact area is restricted. Here, the second contact portion 61*a* of the valve main body portion 61 is in contact with the first contact portion 33*b*1, but the second orifice groove 61*b* of the valve main body portion 61 is not in contact with the first contact portion 33*b*1. Thus, in a state in which the second contact portion 61*a* of the valve main body portion 61 is in contact with the first contact portion 33*b*1, the orifice flow path P2 is formed between the second orifice groove 61*b* of the valve main body portion 61 and the first contact portion 33*b*1. In FIG. 5, the orifice flow paths P2 are formed at two locations in the circumferential direction. The flow path sectional area of each orifice flow path P2 is much smaller than that of the forward flow path P1.

Therefore, the high-pressure fuel in the second low-pressure pipe 16*a* flows to the first low-pressure pipe 14 via the orifice flow paths P2. Thus, change in the pressure of the high-pressure fuel occurring in the pump body 16*b* of the high-pressure pump 16 is inhibited from being directly transferred to the first low-pressure pipe 14. That is, pulsation in the first low-pressure pipe 14 is reduced.

Here, the valve main body portion 61 of the valve body 60 has no through holes. Therefore, in the case where the valve body 60 is in the second state, paths through which fuel is allowed to flow between the area on the first tube portion 31 side and the area on the second tube portion 32 side are only the orifice flow paths P2 between the first contact portion 33*b*1 and the second orifice grooves 61*b*.

(3-3. Effects)

As described above, in the case where the high-pressure fuel flows back, the valve body 60 comes into the second state, so that the orifice flow paths P2 are formed between the inner circumferential surface of the connector body 30 and the valve body 60. That is, the orifice flow paths P2 are interposed between the high-pressure pump 16 and the low-pressure pump 12. Owing to the action of the orifice flow paths P2, pulsation in the first low-pressure pipe 14 on the low-pressure pump 12 side with respect to the connector 15 is reduced.

On the other hand, in the case of the steady state in which the high-pressure fuel does not flow back, the valve body 60 comes into the first state, so that the forward flow path P1 larger than the orifice flow path P2 is formed between the inner circumferential surface of the third tube portion 33 of the connector body 30 and the valve body 60. In the steady state, the valve body 60 comes into the first state in which the forward flow path P1 is formed by the pressure of the low-pressure fuel. Thus, the low-pressure fuel is assuredly supplied to the high-pressure pump 16 side. That is, in the steady state, the valve body 60 does not hamper flow of the low-pressure fuel.

In addition, the valve body 60 is configured to be mounted in the connector 15. Thus, the valve body 60 is easily provided. In particular, the inner circumferential surface of the third tube portion 33 of the connector body 30 is used as a surface for forming the forward flow path P1 and the orifice flow paths P2. Since formation of the connector body 30 is easy, formation of the forward flow path and the orifice flow paths on the inner circumferential surface of the connector body 30 is also easy. Thus, designing and manufacturing of the connector 15 in which the valve body 60 is mounted are facilitated.

Conceivably, the valve body 60 is assumed to be mounted at the first low-pressure pipe 14, instead of being mounted in the connector 15. However, mounting the valve body 60 to the first low-pressure pipe 14 is not easy, as compared to the case of mounting the valve body 60 to the connector body 30. Therefore, in the case of mounting the valve body 60 to the first low-pressure pipe 14, designing and manufacturing are not easy, and thus the cost increases. Therefore, mounting the valve body 60 inside the connector body 30 facilitates designing and manufacturing and thus assuredly exerts the pulsation reducing effect.

In addition, the second contact portion 61*a* of the valve main body portion 61 has a partially spherical shape. Thus, even if the attitude of the valve body 60 is changed when the valve body 60 is in the second state, the second contact portion 61*a* assuredly comes into contact with the first contact portion 33*b*1. That is, in the second state, flow of a high-pressure fluid is assuredly restricted by the first contact portion 33*b*1 and the second contact portion 61*a*, and the orifice flow paths P2 are assuredly formed. Thus, the pulsation reducing effect is assuredly exerted.

Further, the second orifice grooves 61*b* are formed on the valve main body portion 61 of the valve body 60. The valve body 60 has a smaller size as compared to the connector body 30. Thus, adjustment of the orifice flow paths P2 becomes easy.

(4. Structure of Connector 115 in Second Embodiment)

Figure 8:
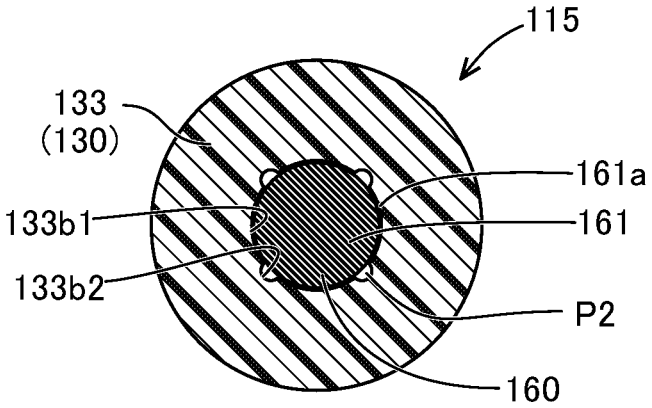
FIG. 8 is a sectional view of a part including a valve body in a connector according to the second embodiment, taken along the radial direction.

The structure of a connector 115 according to the second embodiment will be described with reference to FIG. 8. Here, the same components as those in the connector 15 according to the first embodiment are denoted by the same reference characters and the description thereof is omitted. The connector 115 includes a connector body 130, the retainer 40, the seal unit 50, a valve body 160, the energizing member 70, and the fixation bush 80.

A third tube portion 133 of the connector body 130 is different in that a first orifice groove 133*b*2 is provided at a first contact portion 133*b*1. The first contact portion 133*b*1 is formed in a tapered shape as in the first contact portion 33*b*1 of the first embodiment.

The first orifice groove 133*b*2 is formed so as to extend in the axial direction, or in a helical shape. A plurality of first orifice grooves 133*b*2 are formed at regular intervals in the circumferential direction. Thus, the first orifice grooves 133*b*2 are provided so as to be adjacent to the first contact portion 133*b*1 in the circumferential direction. The number of the first orifice grooves 133*b*2 may be, for example, four, or may be three or less, or five or more. Providing the plurality of first orifice grooves 133*b*2 at regular intervals enables fuel to flow in a balanced manner.

On the other hand, a valve main body portion 161 of a valve body 160 is different only in that the second orifice grooves 61*b* are not provided, as compared to the valve main body portion 61 of the first embodiment. That is, the outer circumferential surface of the valve main body portion 161 is formed in a partially spherical shape having no grooves. Thus, the second contact portion 161*a* of the valve main body portion 161 is formed over the entire range along the circumferential direction.

In the case where the valve body 160 is in the first state, the forward flow path P1 (shown in FIG. 7) is formed between the first contact portion 133*b*1 of the third tube portion 133 and the second contact portion 161*a* of the valve main body portion 161 of the valve body 160. On the other hand, in the case where the valve body 160 is in the second state, as shown in FIG. 8, the orifice flow paths P2 are formed between the first orifice grooves 133*b*2 of the third tube portion 133 and the second contact portion 161*a* of the valve main body portion 161. Thus, the orifice flow paths P2 exert a desired pulsation reducing effect.

What is claimed is:

1. A connector to be connected to a low-pressure pipe through which low-pressure fuel supplied from a low-pressure pump flows, in a fuel supply system in which the low-pressure fuel is pressurized by a high-pressure pump and high-pressure fuel is supplied to an internal combustion engine, the connector comprising:

a connector body formed in a tubular shape, the connector body including a small-diameter tube portion and a large-diameter tube portion; and a valve body stored inside the connector body, the valve body being configured to, when the high-pressure fuel does not flow back, come into a first state in which a forward flow path is formed between the valve body and an inner circumferential surface of the connector body by a pressure of the low-pressure fuel, and when the high-pressure fuel flows back, come into a second state in which an orifice flow path having a smaller flow path sectional area than the forward flow path is formed between the valve body and the inner circumferential surface of the connector body, wherein:

the valve body includes:

a valve main body portion configured to form the forward flow path and the orifice flow path between the valve main body portion and the inner circumferential surface of the connector body;

a first restriction portion formed integrally with the valve main body portion and configured to restrict a posture of the valve body relative to the connector body by coming into contact with the inner circumferential surface of the connector body, the restriction portion including a plurality of first claw-shaped portions; and a second restriction portion formed integrally with the valve main body portion on a side opposite the first restriction portion, the second restriction portion including a plurality of second claw-shape portions, the first restriction portion is a small-diameter restriction portion and the second restriction portion is a large-diameter restriction portion having a larger diameter than the small-diameter restriction portion, the second restriction portion is configured to be contactable with an inner circumferential surface of the large-diameter tube portion to thereby restrict an attitude of the valve body relative to the connector body, and the first restriction portion is configured to be contactable with an inner circumferential surface of the small-diameter tube portion to thereby restrict the attitude of the valve body relative to the connector body.

2. The connector according to claim 1, wherein an outer circumferential surface of the valve main body portion is formed in a partially spherical shape.

3. The connector according to claim 1, wherein the orifice flow path comprises a plurality of orifice flow paths arranged in a circumferential direction of the connector.

4. The connector according to claim 1, wherein the orifice flow path is formed only between the inner circumferential surface of the connector body and the valve body.

5. The connector according to claim 1, wherein the connector body includes a first contact portion configured to, when the valve body is in the first state, become distant from the valve body so as to form the forward flow path, and when the valve body is in the second state, come into contact with the valve body so as to restrict flow of the high-pressure fuel, the connector further comprising a spring configured to energize the valve body toward the first contact portion of the connector body.

6. The connector according to claim 5, wherein the spring is a coil spring, and the valve body includes a mounting portion for mounting the coil spring which is the energizing member.

7. The connector according to claim 5, wherein the valve body includes:

a second contact portion configured to, when the valve body is in the first state, become distant from the first contact portion so as to form the forward flow path, and when the valve body is in the second state, come into contact with the first contact portion so as to restrict the flow of the high-pressure fuel; and a second contact portion orifice groove provided so as to be adjacent to the second contact portion in a circumferential direction of the connector, the second contact portion orifice groove being configured to form the orifice flow path when the valve body is in the second state.

8. The connector according to claim 7, wherein the second contact portion orifice groove includes a plurality of second contact portion orifice grooves disposed along the circumferential direction.

9. The connector according to claim 8, wherein the plurality of second contact portion orifice grooves are disposed at regular intervals along the circumferential direction.

10. The connector according to claim 7, wherein the second contact portion orifice groove has a curved concave cross-section when viewed in a radial direction of the connector.

11. The connector according to claim 5, wherein the connector body includes a first contact portion orifice groove provided so as to be adjacent to the first contact portion in a circumferential direction of the connector, the first contact portion orifice groove being configured to form the orifice flow path when the valve body is in the second state.

12. The connector according to claim 11, wherein the first contact portion orifice groove includes a plurality of first contact portion orifice grooves disposed along the circumferential direction.

13. The connector according to claim 12, wherein the plurality of first contact portion orifice grooves are disposed at regular intervals along the circumferential direction.

14. The connector according to claim 11, wherein the first contact portion orifice groove has a curved concave cross-section when viewed in a radial direction of the connector.

* * * * *